United States Patent [19]

Naramura

[11] Patent Number: 4,494,505

[45] Date of Patent: Jan. 22, 1985

[54] DECELERATION CONTROL DEVICE FOR AN INTERNAL COMBUSTION ENGINE

[75] Inventor: Masaru Naramura, Yokohama, Japan

[73] Assignee: Nissan Motor Co., Ltd., Yokohama, Japan

[21] Appl. No.: 440,534

[22] Filed: Nov. 10, 1982

[30] Foreign Application Priority Data

Jan. 7, 1982 [JP] Japan ..... 57-621

[51] Int. Cl.[3] ..... F02M 7/12

[52] U.S. Cl. ..... 123/325; 123/327

[58] Field of Search ..... 123/325, 327, 320, 332, 123/333, 326, DIG. 11; 261/DIG. 19

[56] References Cited

U.S. PATENT DOCUMENTS

| | | | |
|---|---|---|---|
| 2,443,465 | 6/1948 | Leibing | 123/327 |
| 3,821,943 | 7/1974 | Toda et al. | 123/327 |
| 3,852,391 | 12/1974 | Hisatomi et al. | 261/DIG. 19 |
| 4,008,696 | 2/1977 | Hisatomi | 123/326 |
| 4,123,903 | 11/1978 | Hayashi | 123/327 |

*Primary Examiner*—William A. Cuchlinski, Jr.

*Attorney, Agent, or Firm*—Schwartz, Jeffery, Schwaab, Mack, Blumenthal & Koch

[57] ABSTRACT

A deceleration control device is applied to an internal combustion engine having an air intake passage and a throttle valve disposed in the air intake passage. The device includes a fuel supply cut-off valve and a vacuum control valve. The cut-off valve selectively interrupts and recommences supply of fuel to the engine. The control valve conducts air to the air intake passage downstream of the throttle valve to weaken the vacuum in the air intake passage downstream of the throttle valve and suspends the conduction of the air. The device also includes a mechanism for causing the control valve to suspend the conduction of the air when the cut-off valve recommences supply of fuel.

7 Claims, 3 Drawing Figures

DECELERATION CONTROL DEVICE FOR AN INTERNAL COMBUSTION ENGINE

BACKGROUND OF THE INVENTION

1. Field of the Invention

This invention relates to a device for controlling an internal combustion engine during deceleration.

2. Description of the Prior Art

In a vehicular internal combustion engine, when the throttle valve is closed to decelerate the vehicle or the engine, a strong vacuum develops in the air intake passage or intake manifold downstream of the throttle valve. The vacuum causes a few problems, such as an increase in the consumption of engine lubricant. Accordingly, a vacuum control device is sometimes provided to supply air to the air intake passage downstream of the throttle valve to prevent the development of an excessively strong vacuum at that position.

Some engines have fuel-supply cut-off devices for the purpose of fuel economy. The cut-off device interrupts fuel supply to the engine during deceleration under certain predetermined conditions.

In the case of an engine equipped with both a vacuum control device and a fuel-supply cut-off device, when the engine rotational speed (rpm) decreases to a range at which fuel supply is recommenced or recovered, the vacuum control device usually continues to perform its air supply function. At such a time, there is therefore a chance that the supplied fuel will mix with an excessive amount of air to form an unduly lean air-fuel mixture, which is supplied to the engine.

SUMMARY OF THE INVENTION

It is an object of this invention to provide a deceleration control device including both a vacuum control device and a fuel-supply cut-off device for an internal combustion engine which prevents the supply of an unduly lean air-fuel mixture to the engine when the fuel supply is recommenced or recovered.

In accordance with this invention, a deceleration control device is applied to an internal combustion engine having an air intake passage and a throttle valve disposed in the air intake passage. The device includes a fuel supply cut-off valve and a vacuum control valve. The cut-off valve selectively interrupts and recommences supply of fuel to the engine. The control valve conducts air to the air intake passage downstream of the throttle valve to weaken the vacuum developing in the air intake passage downstream of the throttle valve and suspends the conduction of the air. The device also includes a mechanism for causing the control valve to suspend the conduction of the air when the cut-off valve recommences supply of fuel.

The above and other objects, features and advantages of this invention will be apparent from the following description of a preferred embodiment thereof, taken in conjunction with the drawings.

DESCRIPTION OF THE PREFERRED EMBODIMENTS

Figure 1:
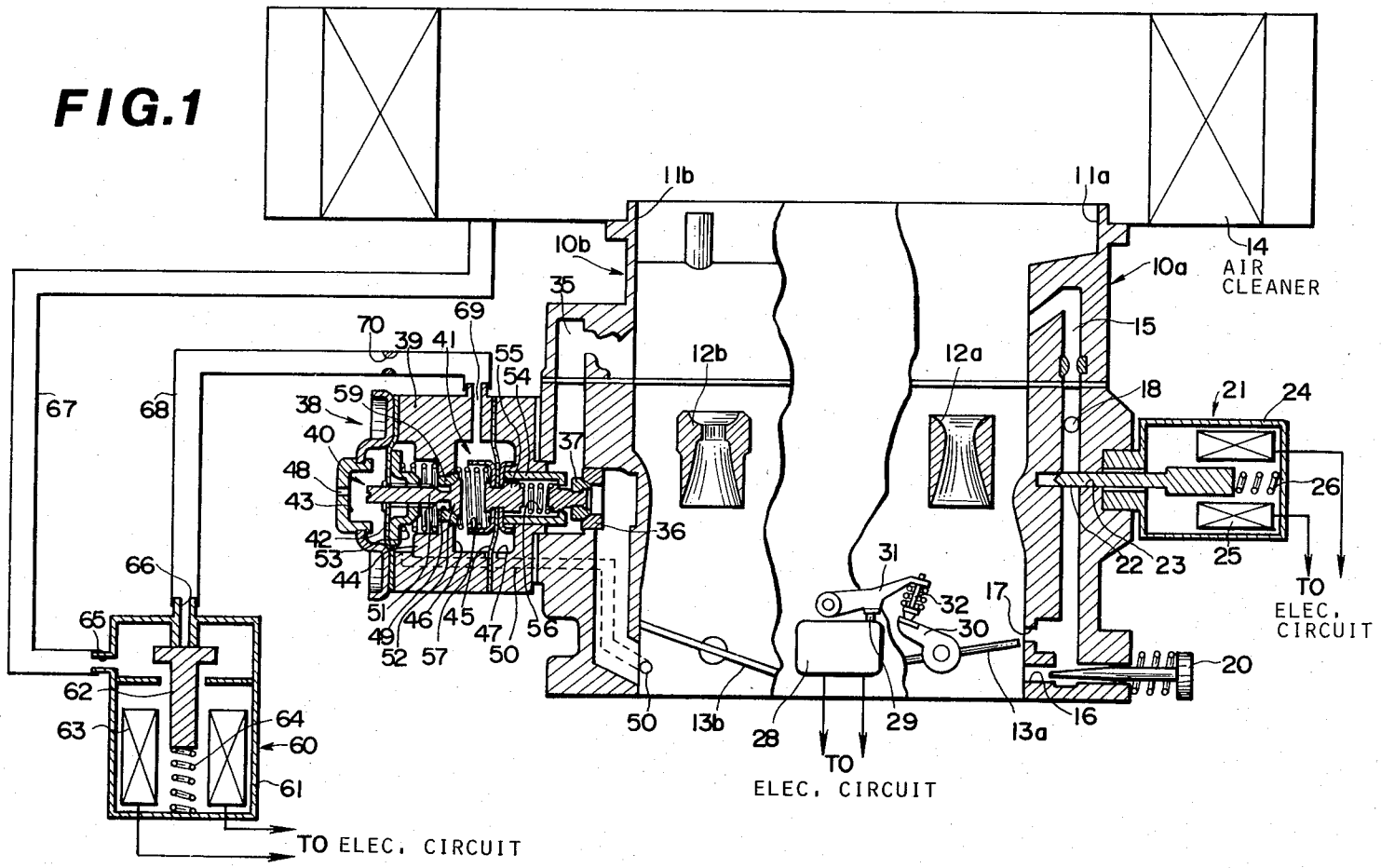
FIG. 1 is a longitudinal section view of a carburetor and associated devices equipped with a deceleration control device of this invention.

Referring to FIG. 1, there is shown a carburetor of a vehicle-driving internal combustion engine and associated devices equipped with a deceleration control device of this invention. The carburetor has primary and secondary barrels 10*a* and 10*b* respectively. The primary barrel 10*a* is provided with an air intake passage 11*a* extending therethrough, a venturi 12*a* disposed within the air passage 11*a*, and a throttle valve 13*a* located in the air passage 11*a* downstream of the venturi 12*a*. One end of the air passage 11*a* is connected to an air cleaner or filter 14, and the other end thereof is connected to engine combustion chambers (not shown) to conduct filtered air to the combustion chambers. A main fuel nozzle opening into the air passage 11*a* at the venturi 12*a* has been eliminated from FIG. 1 for simplicity of illustration. The throttle valve 13*a* is linked to an accelerator pedal (not shown) so as to be actuated by the latter in a customary way.

The secondary barrel 10*b* is provided with a similar air intake passage 11*b* and a similar venturi 12*b*. The secondary barrel 10*b* also includes a throttle valve 13*b* in the air passage 11*b* downstream of the venturi 12*b*. Generally, the throttle valve 13*b* remains closed in the low engine-power range and opens in the high engine-power range by means of a conventional mechanism. The air intake passage 11*b* downstream of the throttle valve 13*b* communicates with the other air passage 11*a* downstream of the throttle valve 13*a*.

The wall of the primary barrel 10*a* defines a passage 15. One end of the passage 15 opens into the air passage 11*a* upstream of the venturi 12*a* and thus upstream the throttle valve 13*a*. The other end of the passage 15 is divided into two ports 16 and 17. The port 16 opens into the air passage 11*a* downstream of the throttle valve 13*a*, and is conventionally called an idle port. In this way, the passage 15 communicates with the air passage 11*a* in such a manner as to bypass the throttle valve 13*a*. The other port 17 opens into the air passage 11*a* immediately upstream of the closed position of the throttle valve 13*a*, and is conventionally called a low-speed port. The wall of the primary barrel 10*a* also defines a fuel passage 18, one end of which opens into the passage 15 upstream of the ports 16 and 17. The other end of the fuel passage 18 is connected in turn to a fuel reservoir or float bowl (not shown) containing fuel.

When the throttle valve 13*a* is closed, air can travel to the combustion chambers via the passage 15. At that time, fuel can enter the passage 15 from the fuel passage 18 and is suspended in the air. In this way, air-fuel mixture can be supplied to the combustion chambers to maintain engine operation even when the throttle valve 13*a* is closed. An idle adjusting screw 20 threadedly engages the wall of the primary barrel 10*a* in such a way that the tip of the screw 20 can move into the idle port 16 to adjustably determine the effective cross sectional area of the port 16. Thus, the flow rate of air-fuel mixture passing through the passage 15 is metered or determined by the screw 20 when the throttle valve 13*a* is closed. In other words, the screw 20 determines the rate of air-fuel mixture supply to the engine during engine idling.

An electrically-driven or electromagnetic valve 21 includes a valve rod 22. The wall of the primary barrel 10*a* has a hole 23 extending from the outer surface thereof to the passage 15 upstream of the ports 16 and 17 but downstream of the connection to the fuel passage 18. The valve rod 22 slidably fits in the hole 23 and can enter the passage 15. The valve rod 22 is designed so that it can selectably block and open the passage 15. The valve 21 also includes a casing 24, a solenoid 25, and a return spring 26. The casing 24 is attached to the outer surface of the primary barrel 10*a*. The solenoid 25 and the spring 26 are disposed in the casing 24. The valve rod 22 extends into the casing 24. The spring 26 is seated between the casing 24 and the valve rod 22 to urge the valve rod 22 toward the closed position in which the valve rod 22 blocks the passage 15. The solenoid 25 is secured to the casing 24 and can drive the valve rod 22. When energized, the solenoid 25 moves the valve rod 22, against the force of the spring 26, from the closed position to the open position in which the valve rod 22 opens the passage 15. When the solenoid 25 is de-energized, the valve rod 22 is returned to the closed position by the force of the spring 26. In this way, when the solenoid 25 is de-energized, the valve rod 22 blocks the passage 15 and thus interrupts the supply of air-fuel mixture to the engine via the passage 15. When the solenoid 25 is energized, the valve rod 22 opens the passage 15 and effects the supply of air-fuel mixture to the engine via the passage 15.

A switch 28 is associated with the throttle valve 13*a* to sense whether or not the throttle valve 13*a* is closed. The switch 28 has a control pin 29 which actuates the former. The control pin 29 is linked to the shaft of throttle valve 13*a* by levers 30 and 31, and a spring-loaded pin 32. The first lever 30 is mounted on the shaft of the throttle valve 13*a*. The second lever 31 is pivotally supported by the carburetor. The pin 32 engages the free ends of the levers 30 and 31. The control pin 29 can contact the second lever 31. The control pin 29 is moved according to the position of the throttle valve 13*a*. The mechanical connection of the switch 28 to the throttle valve 13*a* is designed so that the switch 28 is normally closed but open when the throttle valve 13*a* is closed.

The wall of the secondary barrel 10*b* has a passage 35. One end of the passage 35 opens into the air passage 11*b* upstream of the venturi 12*b* and thus upstream of the throttle valve 13*b*. The other end of the passage 35 opens into the air passage 11*b* downstream of the throttle valve 13*b*. In this way, the passage 35 bypasses the throttle valve 13*b*. A ring 36 stationarily fits in the passage 35 in such a way that the central hole of the ring 36 forms part of the passage 35. A valve member 37 is movably located in the passage 35 adjacent to the ring 36. The valve member 37 has a tapered end. The end of the central hole of the ring 36 conforms to the tapered end of the valve member 37. The tapered end of the valve member 37 can sealingly seat on and separate from the inner surface of the ring 36. When seated on the ring 36, the valve member 37 blocks the central hole of the ring 36 and thus the passage 35. When separated from the ring 36, the valve member 37 opens the central hole of the ring 36 and thus the passage 35 to allow air flow through the passage 35.

An actuator 38 is provided to drive the valve member 37. The actuator 38 has a casing 39 attached to the outer surface of the wall of the second barrel 10*b*. The casing 39 is formed with chambers 40 and 41. A diaphragm 42 deformably supported by the casing 39 divides the first chamber 40 into two sections 43 and 44. Another diaphragm 45 deformably supported by the casing 39 divides the second chamber 41 into two sections 46 and 47. The chamber section 43 is exposed to the atmosphere via an opening 48 formed through the wall of the casing 39. The chamber section 44 can communicate with the chamber section 46 via an aperture 49 in the casing 39. The aperture 49 consists of the central hole of a ring 59 secured to the inner surface of the casing 39. The chamber section 44 communicates with the air passage 11*b* downstream of the throttle valve 13*b* via a passage 50 provided in the wall of the secondary barrel 10*b* and that of the casing 39. In this way, the opposite surfaces of the diaphragm 42 are subjected to the atmospheric pressure and the pressure in the air passage 11*b* downstream of the throttle valve 13*b*, that is, the intake manifold vacuum. As a result, the diaphragm 42 deforms according to the intake manifold vacuum.

A valve rod 51 is fixed to the diaphragm 42 and can move along with the diaphragm 42. The valve rod 51 extends from the first chamber 40 partway into the chamber section 46 of the second chamber 41 through the aperture 49. The end of the valve rod 51 in the chamber section 46 provided with a flange 52. The end surface of the flange 52 facing the diaphragm 42 is tapered. The end of the aperture 49 adjacent to the chamber section 46 conforms to the tapered end of the flange 52. The tapered end of the flange 52 can sealingly seat on and separate from the inner surface of the ring 59 defining the end of the aperture 49. When seated on the inner surface of the ring 59, the valve rod 51 blocks the aperture 49. When separated from the inner surface of the ring 59, the valve rod 51 opens the aperture 49. The outside diameter of the valve rod 51 in the aperture 49 is sufficiently smaller than the diameter of the aperture 49 to ensure an adequate opening of the aperture 49 when the valve rod 51 is separated from the ring 59. A spring 53 disposed in the chamber section 44 is provided between the inner surface of the casing 39 and the diaphragm 42 so as to urge the diaphragm 42 in the direction of seating the valve rod 51 on the inner surface of the ring 59 defining the end of the aperture 49. When the intake manifold vacuum exceeds a predetermined level, the diaphragm 42 moves against the force of the spring 53 to unseat the valve rod 51 from the inner surface of the ring 59 and thus opens the aperture 49. While the intake manifold vacuum is lower than the predetermined level, the diaphragm 42 remains in the normal position and the valve rod 51 remains seated on the inner surface of the ring 59 by the spring 53, so that the aperture 49 remains blocked.

A hollow cylinder 54 slideably extends from the chamber section 47 to the passage 35 through the wall of the casing 39. One end of the cylinder 54 is secured to the diaphragm 45. The cylinder 54 houses part of a spring seat 55 secured to the diaphragm 45 and also houses movably part of the valve member 37. The cylinder 54 houses a spring 56 provided between the seat 55 and the valve member 37. The valve member 37 can engage the cylinder 54 via shoulders respectively formed on the valve member 37 and the cylinder 54. The spring 56 urges the valve member 37 into engagement with the cylinder 54. Force can thereby be transmitted from the diaphragm 45 to the valve member 37 through the spring 56. In other words, the valve member 37 moves according to displacement of the diaphragm 45. A spring 57 disposed in the section 46 is provided between the inner surface of the casing 39 and the diaphragm 45 so as to urge the diaphragm 45 in the direction of seating the valve member 37 on the ring 36. When the aperture 49 is blocked by the valve rod 51, the spring 57 forces the diaphragm 45 into its normal position in which the valve member 37 is seated on the ring 36 to block the passage 35. In this case, the spring 56 can be slightly compressed in order to absorb shock due to seating of the valve member 37 on the ring 36 without allowing disengagement thereof. When the aperture 49 is opened and therefore the intake manifold vacuum is supplied to the chamber section 46 via the passage 50, the chamber section 44, and the aperture 49, the diaphragm 45 can move against the force of the spring 57 and unseat the valve member 37 from the ring 36 to open the passage 35. To prevent the trapping of vacuum in the chamber section 46 when the valve rod 51 blocks the aperture 49, a passage (not shown) of restricted effective cross-sectional area interconnecting the chamber section 46 with the air passage **11*b* upstream of the throttle valve 13*b* is preferably provided in the wall of the casing 39 and that of the secondary barrel 10*b***.

An additional electrically-driven or electromagnetic valve 60 includes a casing 61, a movable valve member 62, a solenoid 63, and a return spring 64. The casing 61 houses the valve member 62, the solenoid 63, and the return spring 64. The casing 61 has openings 65 and 66 capable of being connected to one another through the inside of the casing 61. The first opening 65 is connected by a tube or hose 67 to the connection of the air cleaner 14 to the air passages **11*a* and 11*b* to be supplied with air at atmospheric pressure. The second opening 66 is connected to the chamber section 46 via a tube or hose 68, and a passage 69 provided in the casing 39 and interconnecting the tube 68 and the chamber section 46. The valve member 62 can close and open the second opening 66 to interrupt and establish communication between the openings 65 and 66. The spring 64 is seated between the inner surface of the casing 61 and the valve member 62 to urge the valve member 62 in the direction of closing the second opening 66. The solenoid 63 secured to the casing 61 can actuate the valve member 62. When energized, the solenoid 63 moves the valve member 62 away from the second opening 66 against the force of the spring 64, thereby allowing communication between the openings 65 and 66. In this case, air or atmospheric pressure is supplied to the chamber section 46 via the tubes 67 and 68, the valve 60, and the passage 69. The tube 68 is provided with a restriction 70 therein to limit the rate of air flow therethrough to an acceptable level. When the solenoid 63 is de-energized, the valve member 62 is returned by the spring 64 to the position in which the opening 66 is closed, thereby interrupting communication between the openings 65 and 66 and thus suspending the supply of air or atmospheric pressure to the chamber section 46 via the valve 60. In the case where the valve 60 allows the supply of air or atmospheric pressure to the chamber section 46, the diaphragm 45 remains in its normal position so that the passage 35 remains blocked by the valve member 37 even when the intake manifold vacuum exceeds the predetermined level and opens the aperture 49. This is because the vacuum in the chamber section 46 is diluted or weakened to a predetermined level at which the diaphragm 45 remains in its normal position. In the case where the valve 60 interrupts the supply of air or atmospheric pressure to the chamber section 46, the diaphragm 45 remains in its normal position while the intake manifold vacuum is weaker than the predetermined level and closes the aperture 49, and moves out of the normal position to open the passage 35 as the intake manifold vacuum exceeds the predetermined level and opens the aperture 49**.

Figure 2:
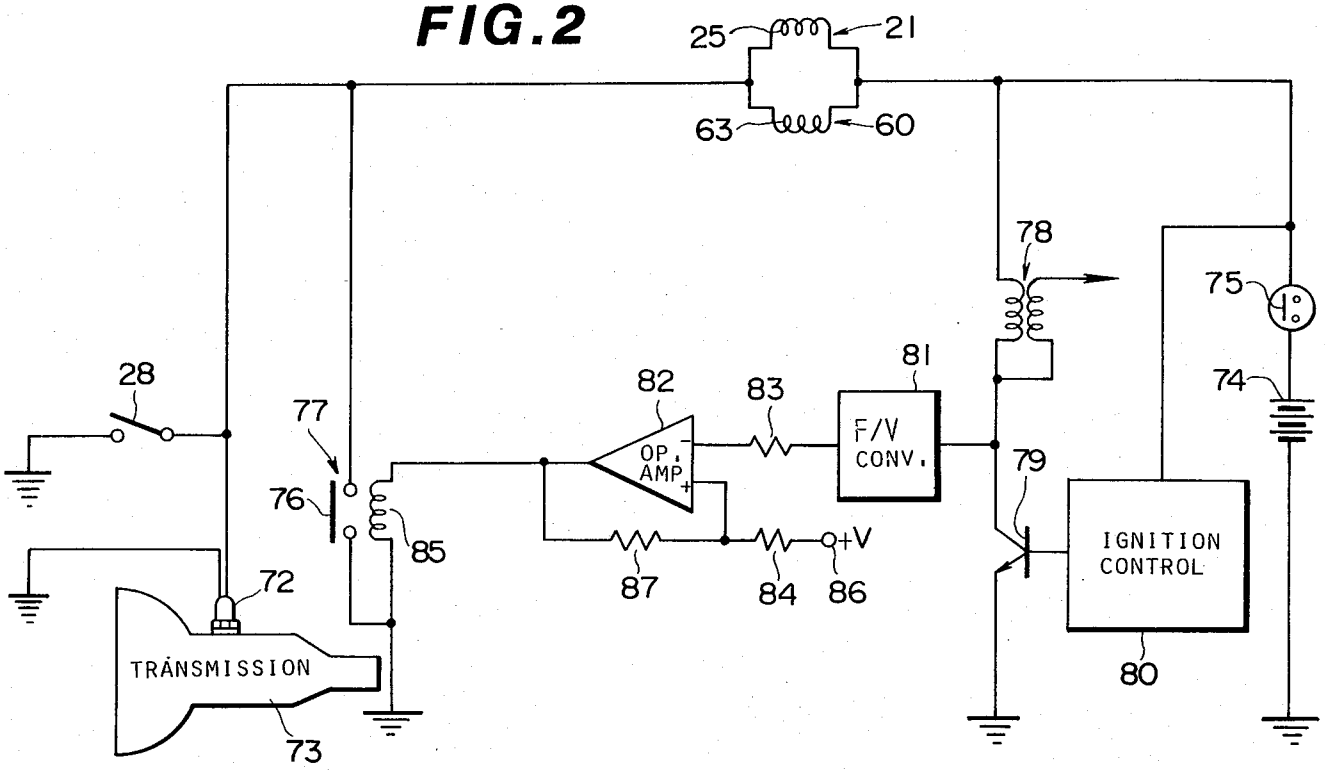
FIG. 2 is a diagram of the electrical circuitry of the control device in FIG. 1.

As shown in FIG. 2, a switch 72 is associated with an engine power transmission 73 to sense whether or not the transmission 73 is in the neutral position. Specifically, the switch 72 is normally open but closed when the transmission 73 is shifted to the neutral position.

A first terminal of the solenoid 25 of the valve 21 is connected to the positive terminal of a battery 74 via an ignition switch 75. The second terminal of the solenoid 25 is grounded via the throttle switch 28. The negative terminal of the battery 74 is also grounded. The solenoid 63 of the valve 60 is connected in parallel with the solenoid 25 of the valve 21. The transmission switch 72 and the switch 76 of a relay 77 are connected in parallel with the throttle switch 28. The solenoids 25 and 63 are energized when any one of the switches 28, 72, and 76 is closed, provided that the ignition switch 75 is closed. The solenoids 25 and 63 are de-energized when the ignition switch 75 is open or when all the switches 28, 72, and 76 are open. The ignition switch 75 is closed while the engine is running.

The primary winding of an ignition coil 78 is connected across the battery 74 via the ignition switch 75 and a switching power transistor 79 in a conventional way. A well-known ignition control unit 80 drives the transistor 79 in such a conventional way that the transistor 79 switches on and off at a frequency proportional to the rotational speed of the engine. Therefore, at the junction of the primary winding of the ignition coil 78 and the transistor 79 there is developed a voltage pulse train whose frequency is proportional to the rotational speed of the engine.

The input terminal of a frequency-to-voltage converter 81 is connected to the junction of the ignition coil 78 and the transistor 79 so that the converter 81 receives the pulse train. The converter 81 generates a voltage whose magnitude is proportional to the frequency of the pulse train, that is, the rotational speed of the engine.

The negative input terminal of an operational amplifier 82 is connected to the output terminal of the converter 81 via a resistor 83. The positive input terminal of the amplifier 82 is connected via resistor 84 to a terminal 86 to which a constant positive voltage +V is applied. The output terminal of the amplifier 82 is connected to the positive input terminal thereof via a resistor 87. The amplifier 82, the resistors 83, 84, and 87 constitute a Schmitt trigger.

The output of the amplifier 82 is low when the engine speed voltage outputted by the converter 81 is greater than a reference voltage V1. The output of the amplifier 82 is high when the engine speed voltage is smaller than another reference voltage V2 less than the reference voltage V1. There is a hysteresis in change in the output of the amplifier 82. Specifically, the output of the amplifier 82 remains unchanged when the engine speed voltage enters the range between the reference voltages V2 and V1. The output of the amplifier 82 goes low when the engine speed voltage rises out of the range between the reference voltages V2 and V1 after having risen into the range. The output of the amplifier 82 remains low when the engine speed voltage rises out of the range between the reference voltages V2 and V1 after having fallen into the range. The output of the amplifier 82 goes high when the engine speed voltage falls out of the range between the reference voltages V2 and V1 after having fallen into the range. The output of the amplifier 82 remains high when the engine speed voltage falls out of the range between the reference voltages V2 and V1 after having risen into the range. Thus, the output of the amplifier 82 is low when the engine rotational speed is greater than a reference speed N1 defined by the reference voltage V1. The output of the amplifier 82 is high when the engine rotational speed is smaller than a less reference speed N2 defined by the reference voltage V2. The output of the amplifier 82 goes low when the engine rotational speed increases out of the range between the reference speeds N2 and N1 after having increased into the range. The output of the amplifier 82 goes high when the engine rotational speed decreases out of the range between the reference speeds N2 and N1 after having decreased into the range. The output of the amplifier 82 remains unchanged in other cases.

The output terminal of the amplifier 82 is grounded via the control winding 85 of the relay 77. When the output of the amplifier 82 is high, the control winding 85 is energized, closing the relay switch 76. When the output of the amplifier 82 is low, the control winding 85 is de-energized, opening the relay switch 76. Therefore, the relay switch 76 is closed when the engine rotational speed decreases out of the range between the reference speeds N2 and N1 after having fallen into the range, and is opened when the engine rotational speed increases out of the range between the reference speeds N2 and N1 after having increased into the range.

In operation, while the throttle valve 13*a* is closed and the transmission 72 is in a gear other than neutral to decelerate the vehicle or the engine, both the switches 28 and 72 are open. In this case, the solenoids 25 and 63 are de-energized when the engine rotational speed is greater than the reference speed N1 so that the relay switch 76 is also open. While the solenoids 25 and 63 are de-energized, the valve 21 blocks the passage 15 and the valve 60 suspends the supply of air or atmospheric pressure to the chamber section 46. Blocking the passage 15 results in the interruption of the air-fuel mixture supply to the engine via the passage 15, thereby effectively reducing the engine rotational speed. In the case where the supply of air or atmospheric pressure to the chamber section 46 is suspended, when the intake manifold vacuum exceeds the predetermined level, the valve rod 51 opens the aperture 49 so that the valve member 37 opens the passage 35. Opening the passage 35 allows the air to enter the air passage 11*b* downstream of the throttle valve 13*b*, weakening or diluting the intake manifold vacuum. When the intake manifold vacuum becomes weaker than the predetermined level, the valve rod 51 blocks the aperture 49 so that the valve member 37 blocks the passage 35, suspending the air supply to the air passage 11*b* downstream of the throttle valve 13*b*. As a result, the maximum of the intake manifold vacuum is essentially limited to an acceptable level defined by the predetermined level. The interruption of the air-fuel mixture supply to the engine via the passage 15 and the allowance of the air supply to the engine via the passage 35 continue while the engine rotational speed drops below the reference speed N1 to the reference speed N2.

When the rotational speed of the engine falls across or below the reference level N2 due to maintaining the closing of the throttle valve 13*a*, the output of the amplifier 82 goes high and thus the relay switch 76 is closed, energizing the solenoids 25 and 63 even if the switch 72 is open. Note that the ignition switch 75 remains closed while the engine is in running. Energizing the solenoid 25 causes the valve 21 to open the passage 15, recommencing or recovering the air-fuel mixture supply to the engine via the passage 15. The mixture-supply recommencement or recovery prevents the engine from stalling. Energizing the solenoid 63 causes the valve 60 to allow the supply of air or atmospheric pressure to the chamber section 46, blocking the passage 35 even if the intake manifold vacuum exceeds the predetermined level. Blocking the passage 35 results in the suspension of the air supply to the air passage 11*b* downstream of the throttle valve 13*b* via the passage 35. The suspension of the air supply prevents the air-fuel mixture supplied to the engine from becoming excessively lean. The suspension of the air supply to the engine via the passage 35 occurs at essentially the same time as the recommencement or recovery of the air-fuel mixture supply to the engine via the passage 15, so that the air-to-fuel ratio of the mixture remains in an acceptable range even at the start of the recommencement or recovery of the mixture supply.

When the throttle valve 13*a* is opened so that the throttle switch 28 is closed, the solenoids 25 and 63 are energized even if both the switches 72 and 76 are open. In this case, the air-fuel mixture supply to the engine via the passage 15 is enabled while the air supply to the engine via the passage 35 is suspended even if the aperture 49 is open.

When the transmission 73 is shifted to the neutral position so that the transmission switch 72 is closed, the solenoids 25 and 63 are energized even if both the switches 28 and 76 are open. In this case, the air-fuel mixture supply to the engine via the passage 15 is enabled while the air supply to the engine via the passage 35 is suspended even if the aperture 49 is open.

Figure 3:
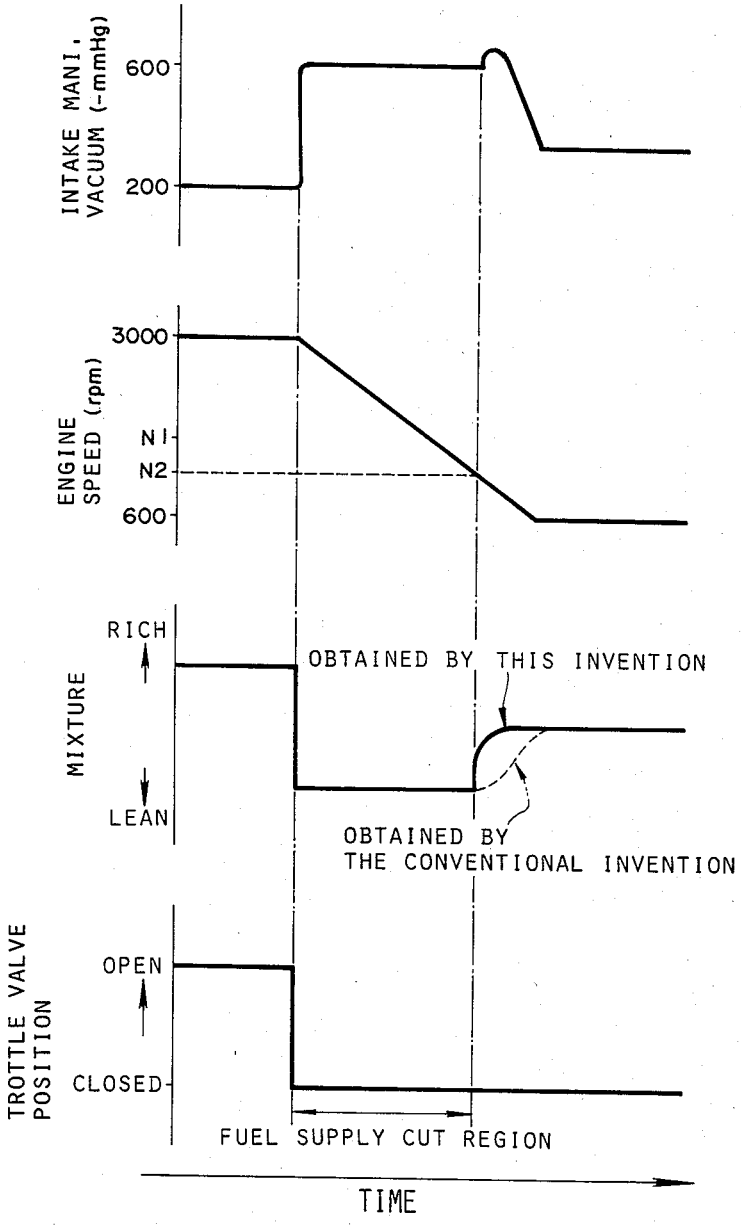
FIG. 3 is a chart of various operating conditions of an engine equipped with the deceleration control device of FIGS. 1 and 2.

Typical operation will be described hereafter with reference to FIG. 3. In the case where the engine rotational speed is higher than the reference speed N1, when the throttle valve 13*a* is closed rapidly, the fuel supply is suspended and the air supply via the passage 35 is enabled. Therefore, the intake manifold vacuum strengthens abruptly to the predetermined level and the resulting air-fuel mixture conducted to the engine goes extremely lean at that time. While the throttle valve 13*a* remains closed, the engine rotational speed decreases, the fuel supply is suspended, and the intake manifold vacuum is limited to or maintained at around the predetermined level. Thereafter, when the engine rotational speed drops to the reference speed N2, and the air-fuel mixture supply is recommenced and the air supply via the passage 35 is suspended. Although the intake manifold vacuum grows slightly stronger, the air-fuel mixture, therefore, goes to the predetermined value as shown by the solid curve quicker than the case of the conventional arrangement as shown by the broken curve, at and after that time.

It should be understood that further modifications and variations may be made in this invention without departing from the spirit and scope of this invention as set forth in the appended claims.

What is claimed is:

1. A deceleration control device for an internal combustion engine having an air intake passage and a throttle valve disposed in the air intake passage, the device comprising:

(a) a first means including a first passage bypassing said throttle valve and an associated fuel supply cut-off valve for selectively admitting and interrupting a supply of fuel to the engine;

(b) a second means for conducting air to a portion of the air intake passage downstream of the throttle valve to dilute vacuum in the air intake passage downstream of the throttle valve;

(c) an air control valve for selectively opening or closing said second means and including means, responsive to the vacuum in the air intake passage downstream of the throttle valve exceeding a predetermined level, for operating the air control valve to open the second means and responsive to said vacuum in the air intake passage downstream of the throttle valve decreasing to said predetermined level to operate the air control valve to block the second bypass means; and (d) a third means for closing said air control valve to suspend the conduction of air by said second means when the fuel supply cut-off valve recommences admitting said fuel supply after interrupting same, said third means including means for supplying air to said air control valve operating means.

2. A deceleration control device as recited in claim 1, wherein the first bypass passage communicates with the air intake passage upstream and downstream of said throttle valve, and said first means further comprises a fuel supply passage opening into the first bypass passage, said fuel supply cut-off valve being positioned downstream of said fuel supply passage opening.

3. A deceleration control device as recited in claim 2, wherein the second means includes a second bypass passage, bypassing said throttle valve and communicating with the air intake passage upstream and downstream of said throttle valve.

4. A deceleration control device as recited in claim 1, wherein the air control valve operating means includes a chamber, a diaphragm connected to said air control valve and defining a wall of the chamber, said diaphragm being responsive to a pressure in the chamber to operate said air control valve and means for selectively supplying the vacuum from the air intake passage downstream of the throttle valve to the chamber to operate the air control valve to open the second means when the vacuum exceeds the predetermined level and suspending the supply of the vacuum to the chamber to operate the air control valve to block the second means when the vacuum weakens to the predetermined level.

5. A deceleration control device for an internal combustion engine having an air intake passage and a throttle valve disposed in the air intake passage, the device comprising:

(a) a first bypass passage bypassing said throttle valve and communicating with the air intake passage upstream and downstream of the throttle valve, a fuel supply passage opening into the first bypass passage, and a fuel supply cut-off valve positioned downstream of said fuel supply passage opening for selectively blocking and opening said first bypass passage for selectively admitting and interrupting a supply of fuel to the engine;

(b) a second bypass passage bypassing said throttle valve and communicating with the air intake passage upstream and downstream of the throttle valve and an air control valve operable for selectively blocking and opening said second bypass passage for conducting air to a portion of the air intake passage downstream of the throttle valve to dilute the vacuum in the air intake passage downstream of the throttle valve;

(c) means for suspending the conduction of air by said second means when the first means recommences admitting said fuel supply after interrupting same;

(d) means, responsive to the vacuum in the air intake passage downstream of the throttle valve exceeding a predetermined level, for operating the air control valve to open the second bypass passage and responsive to said vacuum in the air intake passage downstream of the throttle valve decreasing to said predetermined level to operate the air control valve to block the second bypass passage, said means for operating the air control valve comprising a chamber, a diaphragm connected to said air control valve and defining a wall of the chamber, said diaphragm being responsive to a pressure in the chamber to operate said air control valve and means for selectively supplying vacuum from the air intake passage downstream of the throttle valve to the chamber to operate the air control valve to open the second bypass passage when the vacuum exceeds the predetermined level and for interrupting the vacuum to the chamber to operate the air control valve to block the second bypass passage when the vacuum weakens to the predetermined level; and (e) means for supplying air to the chamber to operate the air control valve to block the second bypass passage when the fuel supply out-off valve opens the first bypass passage.

6. The deceleration control device of claim 5 wherein said fuel supply cut-off valve comprises a first solonoid valve operable to be energized to open said first bypass passage and said sixth means comprises a second solonoid valve operable to be energized to supply said air to said chamber.

7. The deceleration control device of claim 6 wherein said internal combustion engine has an ignition system with a power source and an associated transmission and said first and second solonoid valves are operable to be energized by said power source whenever said throttle valve is open or said transmission is in a neutral position or said internal combustion engine is operating in a predetermined speed range.

* * * * *